US005414450A

United States Patent [19]

Oshino et al.

[11] Patent Number: 5,414,450

[45] Date of Patent: May 9, 1995

[54] HEAD PRESSING MECHANISM OF A THERMAL PRINTER

[75] Inventors: Genzi Oshino; Isamu Suzuki, both of Miyagi, Japan

[73] Assignee: Tohoku Richo Co., Ltd., Miyagi, Japan

[21] Appl. No.: 985,202

[22] Filed: Dec. 3, 1992

[30] Foreign Application Priority Data

Dec. 6, 1991 [JP] Japan ..... 3-322232

[51] Int. Cl.[6] ..... B41J 25/304; B41J 25/312; B41J 25/308; B41J 25/316

[52] U.S. Cl. ..... 342/197 PH; 346/145; 400/55; 400/60

[58] Field of Search ..... 346/76 PH, 145; 400/120, 55, 60

[56] References Cited

U.S. PATENT DOCUMENTS 125,871 6/1886 Hashizume ..... 346/76 PH

FOREIGN PATENT DOCUMENTS 59-38909 9/1984 Japan .
3-23443 3/1991 Japan .

*Primary Examiner*—Huan H. Tran

*Attorney, Agent, or Firm*—Armstrong, Westerman, Hattori, McLeland, & Naughton

[57] ABSTRACT

A thermal printer comprising a line type thermal head which is arranged substantially in parallel with the shaft of a platen and is swingably supported about the longitudinal central portion thereof can obtain clear printed letters and prevent the abrasion of the platen due to the direct contact between the thermal head and the platen even if the recording paper varies in width or thickness or is set on the platen one-sided. To achieve the above object, members for restricting the swinging of the thermal head are prodded at both end portions thereof, one of the members being adjustable in its restricting position and the thermal head is supported by a head supporting means composed of a head plate, a head frame and tension springs so as to be movable toward or away from the platen so that the thermal head is separated from the platen according to the thickness of the recording paper and does; not contact the platen. When the thermal head is separated from the platen, the stopper portions of the head plate move while contacting the outer circumferences of beatings for supporting the platen so that the printing line of the thermal head is not displaced out of a given printing position.

7 Claims, 11 Drawing Sheets

HEAD PRESSING MECHANISM OF A THERMAL PRINTER

FIELD OF THE INVENTION

The present invention relates to a thermal printer employing a line type thermal head, particularly, to a head pressing mechanism used therein for printing on tag or label papers.

DESCRIPTION OF PRIOR ART

Conventional thermal printers employ a head pressing mechanism, for example, those as disclosed in Japanese Patent Publication No. 59-38909.

It will be described hereinafter briefly with reference to FIG. 13.

A line type thermal head 42 serving as a recording head is provided above a platen 41 composed of a rubber roller along the longitudinal direction thereof. The line type thermal head 42 is fixed to a tip end of a lever 43 substantially at the longitudinally central portion thereof, and a shaft 44 is inserted into a long hole 43*a* formed in the other end portion of the lever 43 so as to support the thermal head 42.

Elastic pressing pieces 45 and 46 are arranged respectively at the portions of the thermal head 42 corresponding to the longitudinal both ends of the platen and are fixed to the thermal head 42 by way of fixing pieces 47 and 48. With this arrangement each of the pressing pieces 45 and 46 is elastically deformed as illustrated in FIG. 13 so as to apply pressure uniformly distributed along the longitudinal direction of the thermal head 42 thereto for printing on a printing paper P with uniform density.

There is also a thermal head printer such as disclosed in Japanese Utility Model Application Laid Open Publication No. 3-23443, having a head pressing mechanism as illustrated in FIGS. 14 and 15.

In the figures, a head supporting plate 49, swingably supported by a base plate 58 about a fixing screw 57 at the portion of the head supporting plate 49 substantially corresponding to the longitudinally central portion of the platen 51, supports the line type thermal head 52 by way of a head supporting member 53. A flat spring 54 presses the central portion of the head supporting plate 49 so as to press the thermal head 52 against the platen 51 by way of the head supporting member 53.

The pressure applied to the platen 51 by way of the head supporting plate 49 can be increased or decreased by pressure adjusting members 55 and 56 composed of a pair of cams each eccentrically fixed on both the end portion of the control shaft 50 rotatably supported by the base plate 58.

When the pressure applied to the platen 51 by the thermal head 52 is not longitudinally uniform so that the printed letters are not clear at some portions, the head pressing mechanism turns the control shaft 50 in normal or reverse direction according to the printed condition, so that a pair of the pressure adjusting members 55 and 56 turns so as to press down the thermal head 52 by way of the head supporting plate 49 and increase the pressure applied to the platen 51 at the side where the printed letters are not clear and reduces the pressure at the other side.

Accordingly, the thermal head 52 turns about the fixing screw 57 at the central portion of the head supporting plate 49 and is pressed at the central portion thereof by the flat spring 54 and at both end portions thereof by a pair of the pressure adjusting members 55 and 56 which have been turned respectively so as to adjust the pressure. As a result, the pressure applied to the platen 51 by the thermal head 52 becomes substantially uniform in all the area along the axis thereof.

However, in case of the former head pressing mechanism as illustrated in FIG. 13, some kinds of recording paper (e.g., tag papers or label papers) are sometimes set to be one-sided relative to the thermal head 42, which causes trouble, although there is no problem when the recording paper P is set on the platen 5 in such a way as to extend on both sides of the lever 43 in the lateral direction of the paper.

For example, when the recording paper P in FIG. 13 has a narrow width (e.g., a half of the optimum paper width) and is set one-sided to the side of the pressing piece 46, the thermal head 42 is liable to be inclined in the direction designated by the arrow A about the lever 43 since there is no recording paper P between the platen 41 and the thermal head 42 on the side of the pressing piece 45, the density of the printed letters on the recording paper P is liable to be extremely low on the side of the pressing piece 48.

Besides, it is feared that the platen 41 may be worn away due to the direct contact between the thermal head 42 and the platen 41 on the side of the pressing piece 45 if the recording paper P is thin.

On the other hand, there is a similar problem in the latter head pressing mechanism as illustrated in FIGS. 14 and 15 since the swingable head supporting plate 49 for supporting the thermal head 52 by way of the head supporting member 53 turns about the fixing screw 57 if the recording paper is set one-sided in the longitudinal direction of the platen 51.

Furthermore, in case that the recording papers such as tag papers or label papers which are held between the platen 51 and the thermal head 52 varies in thickness, printing cannot be performed with the cams 55 and 56 as they are since the control shaft 50 for fixing the cams 55 and 56 of the pressure adjusting member is rotatably supported by the base plate 58 as easily understood by FIG. 15.

For example, when a narrow recording paper having a width about one fourth of that of the platen 51 and having some thickness which is set on the platen 51 right adjusted in FIG. 14 is fed under the thermal head 52, it is necessary to change the position of the pressure adjusting member 56 by the amount corresponding to the thickness of each recording paper by turning the control shaft 50 and lift the thermal head 52 at the right side thereof to make a gap for passing the recording paper therethrough.

Accordingly adding to the troublesome operation, there is another problem that the thermal head 52 is liable to contact the platen 51 at the left side thereof causing the abrasion of the platen 51 since the left pressure adjusting member 55 integrally formed with the control shaft 50 is also turned in the direction to press down the left side of the thermal head 52 by the same amount as a result of turning the control shaft 50.

SUMMARY OF THE INVENTION

The present invention has been made to solve the problems of the conventional thermal printers as set forth above and provide a thermal printer which can deal with recording papers such as tag papers or label papers having different width and thickness and which can produce clear printed letters even when the recording paper is set one-sided in the longitudinal direction of the platen, and furthermore which can prevent the platen from abrasion due to the direct contact with the thermal head.

In order to achieve the above object, the present invert;ion provides a thermal printer comprising a line type thermal head arranged in parallel with the axis of a cylindrical platen having a shaft and swingably supported at the longitudinally central portion thereof as set forth above, wherein the thermal printer further comprises positioning members which are mounted on both ends of the shaft of the platen, each of the positioning members having circular-arc edge portions center of which is in common with the platen at least at a part of the outer circumference thereof, contacting members integrally formed with the thermal head for allowing the printing line of the thermal head to face a given position on the outer circumference of the platen when they are brought into contact with the edge portions of the positioning members, a head supporting means for supporting the thermal head so that the thermal head is movable toward or away from the platen and a means for pressing the thermal head toward the platen, and further comprises swinging restriction means provided on the head supporting means at both longitudinal ends of the platen for restricting the swinging of the thermal head about the longitudinal central portion thereof so as to form a head pressing mechanism.

With the arrangement set forth above, the thermal printer can deal with a thick recording paper without providing any additional component by displacing the thermal head apart from the paper according to the thickness thereof since the thermal head is movable toward or apart from the platen by way of the head supporting means. When a narrow recording paper is set on the platen one-sided to one longitudinal end thereof, the platen is prevented from abrasion due to the contact with the thermal head since the latter is displaced away from the platen while it is inclined corresponding to the thickness of the recording paper.

Moreover, when the thermal head is displaced away from the platen, the printing line of the thermal head is prevented from being displaced from a given printing position on the outer circumference of the platen since the contacting members integrally formed with the thermal head move along the circular-arc edge portions of the positioning members mounted on both ends of the shaft of the platen so that a clear printing can be performed.

Furthermore, if a means for adjusting the restricting position of either of the swinging restriction means is provided in the head pressing mechanism, it is possible to make the pressure applied to the platen by the thermal head substantially uniform.

Still furthermore, the swinging restriction means may restrict the swinging of the thermal head by allowing the stoppers respectively provided on the head supporting means at the positions corresponding to the longitudinal both ends of the platen to be in contact with a head plate fixed to the thermal head being integrally formed therewith, and either of the restricting positions may be adjusted by inserting a position adjusting member formed of a plate having a given thickness between one of the stoppers and the head plate.

In this way, it is possible to print properly on the recording paper according to the width thereof by a simple operation of inserting the position adjusting member between one of the stoppers and the head plate or removing the same therefrom, so that it is possible to always obtain clear printed letters and at the same time it is possible to prevent the platen from abrasion even when printing is performed on a narrow paper set one-sided on the platen.

It is also possible to obtain clearer printed letters by providing a pressure adjusting means for adjusting the pressure applied to the platen by the thermal head since the pressure can be adjusted to an optimum value according to the thickness, the longitudinal set position on the platen and the width of the recording paper.

Moreover, the exchange of the thermal head can be facilitated by providing a pressure switching means which can switch the pressure applied to the platen by the thermal head on and off and switching the same to the position for switching off the pressure.

The above and other objects, features and advantages of the invention will be apparent from the following detailed description which is to be read in conjunction with the accompanying drawings.

DETAILED DESCRIPTION OF THE PREFERRED EMBODIMENT

An embodiment of the present invention will be concretely described hereinafter with reference to drawings.

An arrangement of a portion relating to the head pressing mechanism of a thermal printer according to the present invention will be described hereinafter with reference to FIGS. 1 to 7.

Figure 1:
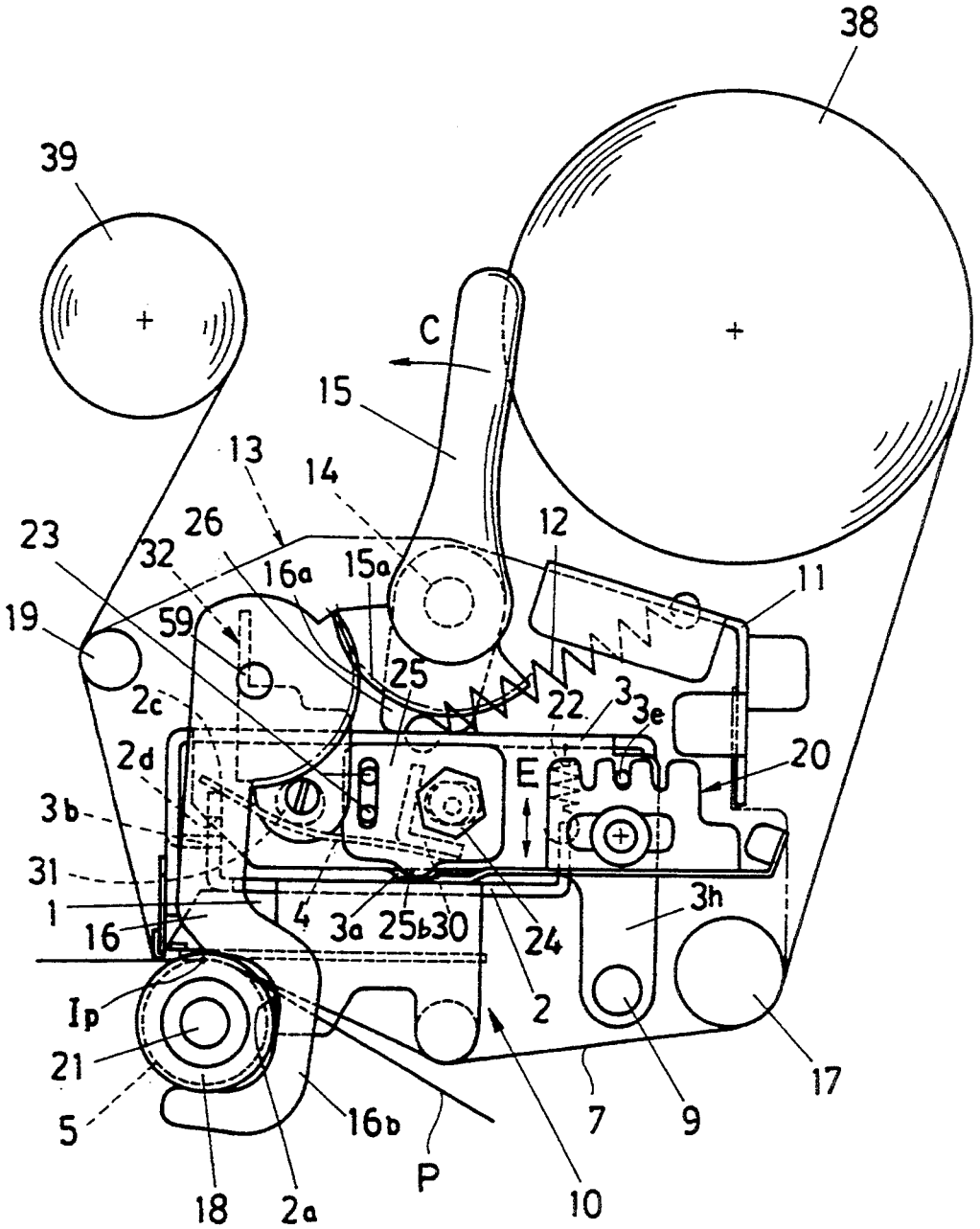
FIGS. 1, 2 and 3 are a front, a left side and a plan views showing a portion relating with a head pressing mechanism of a thermal printer according to an embodiment of the present invention.
Figure 2:
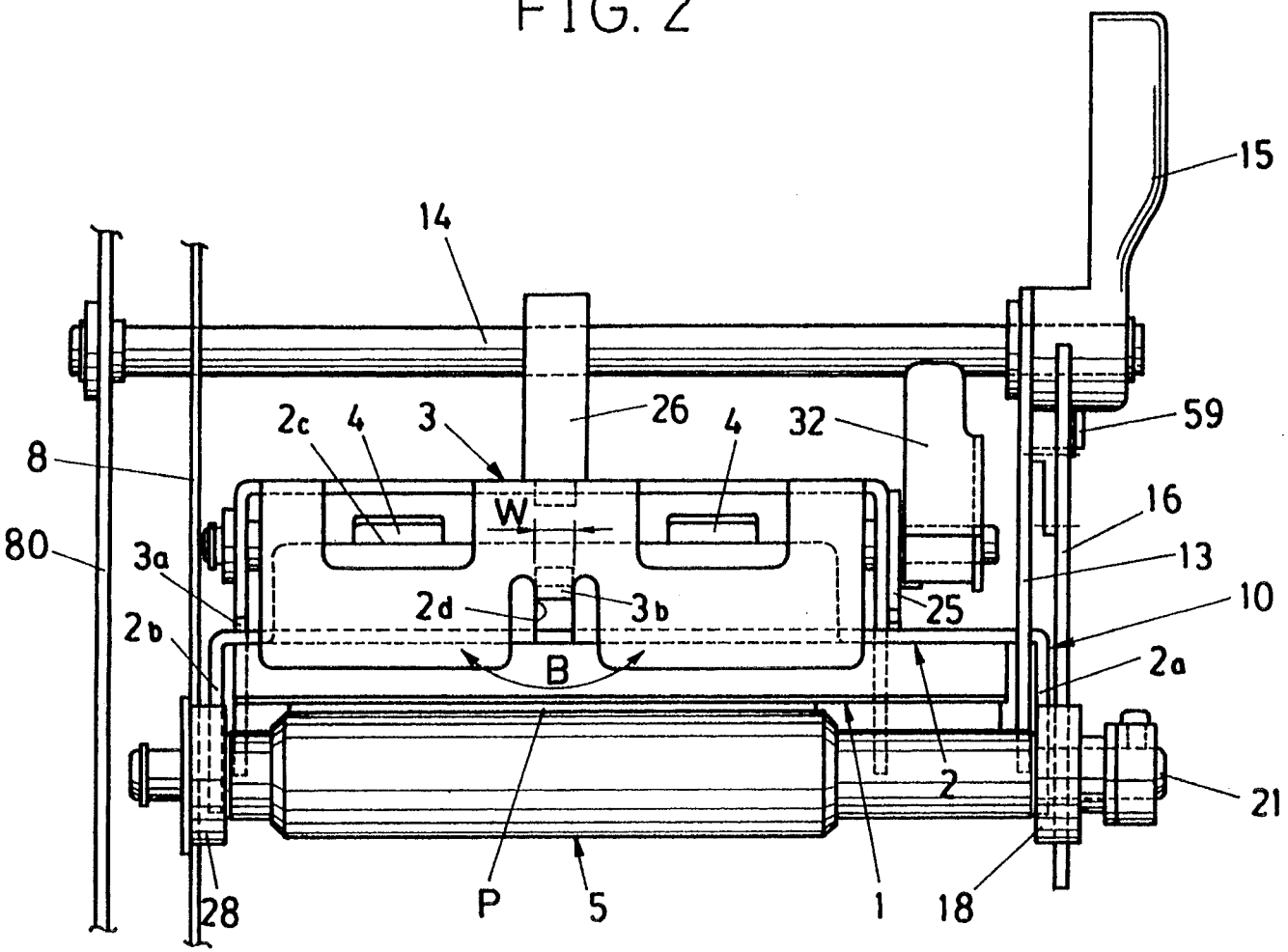
Figure 3:
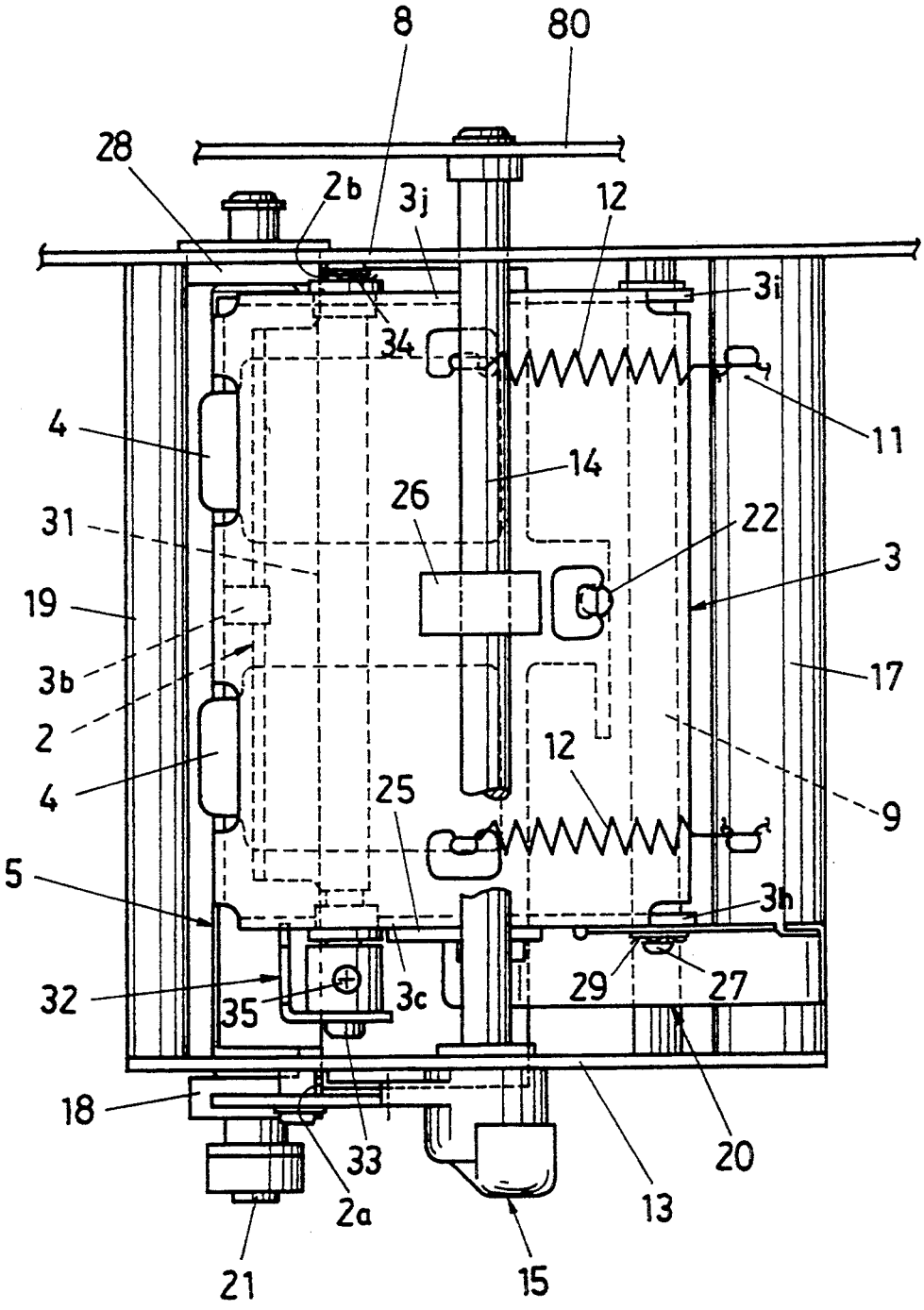

The thermal printer illustrated in FIGS. 1 to 3 is a thermal transfer type thermal printer comprising a line type thermal head 1 arranged substantially in parallel with the shaft 21 of a cylindrical platen 5, which thermal head 1 is supported so as to be swingable about the longitudinally central portion thereof in the direction of the arrow B as illustrated in FIG. 2.

To describe it more in detail, bearings 18 and 28 which serve as cylindrical positioning members having their centers in common with the shaft 21 are fixed to both end portions of the shaft 21 of the platen 5.

The thermal head 1 is held by a head plate 2 integrally formed therewith and is so constructed that the printing line thereby confronts a given printing position $I_p$ (FIG. 1) on the outer circumference of the platen 5 when stopper portions 2*a* and 2*b* which are formed at both end portions of the head plate 2 by bending the same are brought into contact with the outer circumferences (edge portions) of the bearings 18 and 28.

The thermal head 1 is held by a head supporting means composed of a head frame 3, tension springs 12 and 22 (FIGS. 1 and 3), the head plate 2, etc. so as to be movable toward or away from the platen 5 (in the direction of the arrow E in FIG. 1) and swingable in the direction of the arrow B in FIG. 2 and is biased by flat springs 4 and 4 serving as pressing means toward the platen 5.

A stopper 25 and a stopper portion 3*a* extending downward are provided on the head frame 3 each corresponding to the longitudinal ends of the platen 5 serving as a swinging restriction means for restricting the swinging of the thermal head 1 in the direction of the arrow B so as to restrict the swinging of the thermal head 1 by allowing them to contact the upper surface of the head plate 2 integrally formed with the thermal head 1.

The stopper 25 on the front side in FIG. 1 (on the right side in FIG. 2) includes a vertical long hole 25*a*, to which two guiding projections 23 and 23 fit so that the stopper 25 can be vertically moved as a whole.

When an eccentric member 24 provided on the stopper 25 is turned, the vertical position of the stopper 25 relative to the head frame 3 can be adjusted so as to vary the inclination of the thermal head 1 relative to the platen 5 (the inclination in the direction of the arrow B in FIG. 2) for adjusting the pressure applied to the platen 5 to be substantially uniform all over the surface of the platen 5 in the axial direction thereof.

Moreover, the inclination of the thermal head 1 relative to the platen 5 can be varied by inserting the two-staged thick tip side (the left side in FIG. 1) of a head balance switching lever 20 between the projection 25*b* (FIG. 5) at the lower end of the stopper 25 and the upper surface of the head plate 2. It will be described more in detail later.

Figure 4:
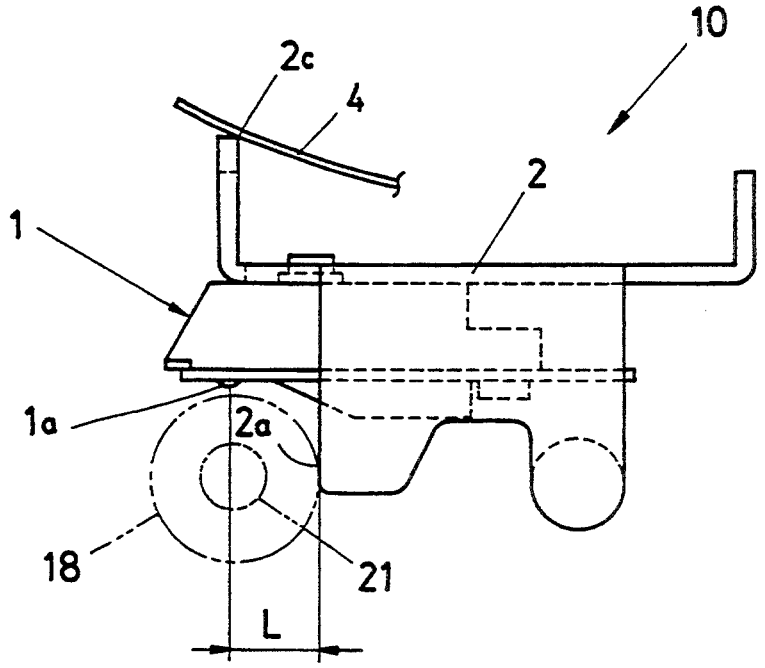
FIG. 4 is a front view showing a head assembly 10 which is provided in the thermal printer in FIG. 1.

Thereupon, the thermal head 1 according to this embodiment is fixed to the head plate 2 so as to form a head assembly 10 as illustrated in FIG. 4 and is mounted on the device in such a situation. A receiving portion 2*c* for receiving the load of a flat spring 4 is formed at the upper end of the head plate 2.

When a lever 15 is turned to the position illustrated in FIG. 1, the head frame 3 is pressed down by a pressing cam 26, so that the head plate 2 is pressed down by the pressure of the flat spring 4 and is pushed leftward in the figure, whereby the stopper portion 2*a* on the front side and the stopper portion 2*b* on the back side are respectively brought into contact with the bearing 18 and, respectively, 28.

In the head assembly 10, the thermal head 1 and the head plate 2 are combined with each other so as to have a given (with little variation) distance L between the printing portion 1*a* of the thermal head 1 and the stopper portions 2*a* and 2*b* (FIG. 2).

The head assembly 10 presses the thermal head 1 against the platen 5 as the flat spring 4 presses down the receiving portion 2*c* which is illustrated in the upper left portion of the head plate 2 in FIG. 1. An image is formed on a tag paper (recording paper) P clamped between the thermal head 1 and the platen 5 by way of a thermal transfer ribbon 7 by rotating the platen 5 counterclockwise in FIG. 1 while selectively printing thereon.

The flat spring 4 is mounted on the head frame 3 by way of a fixing plate 30 at the right side thereof as a cantilever spring.

The flat spring 4 is aslant in contact with the head plate 2, so that the head plate 2 is not only biased downward but also leftward in FIG. 1.

Accordingly, since the stopper portions 2*a* and 2*b* of the head plate 2 are also pressed leftward in FIG. 1, they are always in contact with the outer circumference of the bearings 18 and 28, so that the printing line of the thermal head 1 always confronts a given printing position $I_p$ on the outer circumference of the platen 5 without getting out of position.

The head frame 3 is rotatably mounted on a head unit fulcrum shaft 9 fixed to a side plate 8 at the leg portions 3*h* and 3*i* thereof formed on the front side and back side respectively and is biased at the upper surface thereof by tension springs 12 and 12 which are fixed to the head frame 3 on the front side and back side respectively on one sides thereof and to a stay 11 fixedly mounted between the side plates 13 and 8 (FIG. 3) at the other sides thereof as illustrated in FIG. 3. As a result the head frame 3 can freely turn about the head unit fulcrum shaft 9.

The front side plate 13 which is illustrated in FIGS. 2 and 3 is fixed to the side plate 8 by way of a feeding side ribbon guiding shaft 17, take-up side ribbon guiding shaft 19 and the stay 11 (FIG. 1) which are fixed to the back side plate 8.

The feeding side ribbon shaft 17 guides a thermal transfer ribbon 7 fed by the feeding reel 38 along the outer circumference thereof, while the take-up side ribbon guiding shaft 19 guides the thermal transfer ribbon 7 which-has passed the printing portion along the outer circumference thereof so that the thermal transfer ribbon 7 is rolled round the take-up reel 39 as illustrated in FIG. 1.

The head frame 3 comprises a retaining pawl 3*b* having a width W projecting inward at the substantially laterally central portion thereof, and the head plate 2 comprises a retaining hole 2*d* having a width a little wider than that of the retaining pawl 3*b*, i.e., W at the position corresponding to the retaining pawl 3*b* as illustrated in FIG. 1. The thermal head 1 incorporated in a head assembly 10 can be mounted on the head frame 3 with accuracy regarding to the lateral position relative to the head frame 3 by engaging the retaining pawl 3*b* with the retaining hole 2*d* as illustrated in FIG. 2.

The head assembly 10 is mounted on the head frame 3 by allowing the retaining pawl 3*b* to engage the retaining hole 2*d* and fixing the tension spring 22 between the upper end of rear portion (right in FIG. 1) of the head plate 2 so as to be movable laterally in FIG. 1.

With such arrangement as set forth above according to this embodiment, it is possible to always conform the printing line (printing portion) 1*a* of the thermal head i to a given printing position on the platen 5 even if the frame, not shown, etc. on which the platen 5 is mounted is varied in dimension, since the stopper portions 2*a* and 2*b* of the head plate 2 are brought into contact with the outer circumferences of the front and rear bearings 18 and 28 respectively when the head plate 2 is pressed by the flat spring 4 so that the printing portion of the thermal head 1 is properly positioned relative to the platen 5.

The stopper portion 3*a* formed at the lower end of the head frame 3 at the back side and the stopper 25 which is vertically adjustably mounted on the front side of the head frame 3 function to prevent the head assembly 10 from turning counterclockwise in FIG. 1 due to the bias of the tension spring 22.

It is possible to press the thermal head 1 against the platen 5 uniformly along the longitudinal direction thereof without partially pressing the former against the latter on the front side or on the back side.

Whereas the inclination of the thermal head 1 relative to the platen 5 (deviation from parallel due to the swinging in the direction of the arrow B in FIG. 2) can be varied by the head balance switching lever 20 set forth above.

The head balance switching lever 20 comprises a two-staged tip end portion composed of a thin-plate portion 20*a* having a thickness of $t_1$ and a thick plate portion 20*b* having a thickness of $t_2$. It is possible to vary the inclination of the thermal head 1 relative to the platen 5 by inserting none or either of the plate portions 20*a* and 20*b* between the lower end of the stopper 25 and the upper surface of the head plate 2.

The tension spring 22 pulls up the head plate 2 toward the head frame 3 so as to allow the projection 25*b* at the lower end of the stopper 25 to contact either of the thin plate portion 20*a*, the thick plate portion 20*b* and the upper surface of the head plate 2 in any case where the thin plate portion 20*a* or the thick plate portion 20*b* is set beneath the projection 25*b* at the lower end of the stopper 25 or none of the two is set therebeneath.

Three U-shaped positioning grooves 20*c*, 20*d* and 20*e* are formed on the vertical surface of the head balance switching lever 20. Under the grooves 20*c*, 20*d* and 20*e* is formed a horizontal long hole 20*f*, into which a fixing screw 27 is inserted and is screwed into a screw hole formed on the front side surface 3*c* of the head frame 3.

When the fixing screw 27 is fixed thereto, a wave washer 29 (also refer to FIG. 3) is inserted between the fixing screw 27 and the head balance switching lever 20 so as to selectively position the head balance switching lever 20 while it is pressed against the side surface 3*c* of the head frame 3 by a given force.

Figure 5:
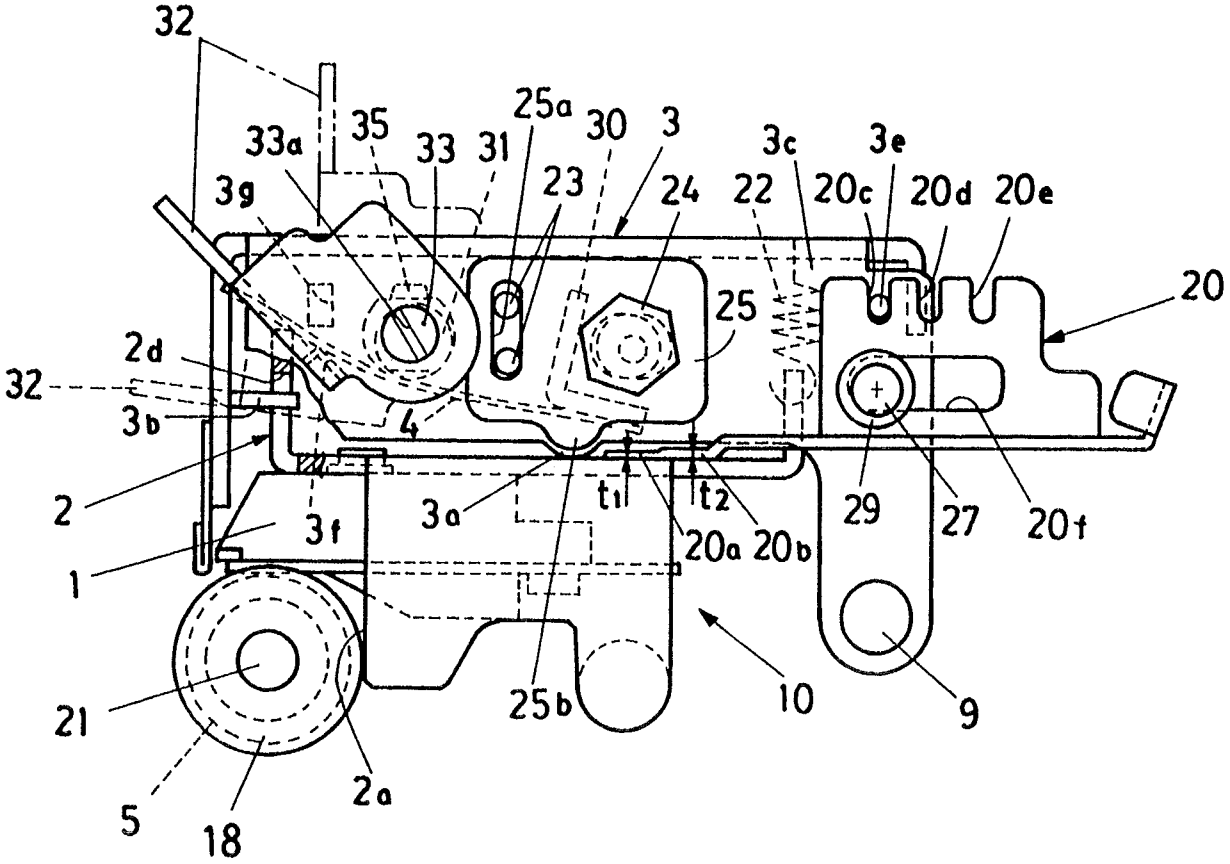
FIG. 5 is a front view for explaining a main portion of the pressure adjusting means in FIG. 1.

The head balance switching lever 20 can be shifted left and right relative to the head frame 3 as illustrated in FIG. 5 by changing the engaging groove of the positioning grooves 20*c*, 20*d* and 20*e* which engages a semi-spherical projection 3*e* provided on the head frame 3.

According to this embodiment, both of the thin plate portion 20*a* and the thick plate portion 20*b* does not contact the projection 25*b* of the stopper 25 when the positioning groove 20*c* of the head balance switching lever 20 engages the semi-spherical projection 3*e* as illustrated in FIG. 5, the thin plate portion 20*a* is inserted beneath the projection 25*b* of the stopper 25 when the positioning groove 20*d* engages the semi-spherical projection 3*e* as illustrated in FIG. 1 and the thick plate portion 20*b* is inserted beneath the projection 25*b* when the positioning groove 20*e* engages the semi-spherical projection 3*e*.

Furthermore, the pressure applied by the thermal head 1 to the platen 5 on which a tag paper P having a width almost as wide as the longitudinal length of the platen 5 as illustrated in FIG. 2 is previously adjusted so as to be substantially uniform along the longitudinal direction of the platen 5.

As described above, since the upper surface of the head plate 2 of this thermal printer contacts the stopper 25, directly or by way of the thin plate portion 20*a* or the thick plate portion 20*b* of the head balance switching lever 20, or directly contacts the stopper portion 3*a* on the back side of the head frame 3, the thermal head 1 is pressed against the platen 5 while being parallel with the latter even if the tag paper P is so narrow as a half of the longitudinal length of the platen 5 and moreover it is set one-sided adjusted to the back side (left side in FIG. 2) or to the front side (right side in FIG. 2), so that uniformly printed letters can be obtained all over the whole width of the tag paper P and the thermal head 1 does not rub the platen 5.

The pressure applied to the platen 5 by the thermal head 1 can be adjusted by turning the lever 32 so as to turn an eccentric cam 31 as illustrated in FIG. 5.

The eccentric cam 31 is integrally mounted on a cam shaft 33 rotatably supported between the front and back side surfaces 3*c* and 3*j* of the head frame 3 as indicated by a broken line in FIG. 3. The cam shaft 33 is longitudinally a little slidable when no load is applied thereto, so that the cam shaft 33 is biased toward the back side by a wave washer 34 mounted on the side surface 3*j* of the head frame 3.

The eccentric cam 31 restricts the pressure applied to the head plate 2 by the flat spring 4 by contacting the upper surface of the substantially central portion of the flat spring 4 as illustrated in FIG. 5.

Accordingly, when the lever 32 fixed to one side of the cam shaft 33 for rotating together with the eccentric cam 31 is turned, the position of the eccentric cam 31 which contacts the flat spring 4 charges and the pressure pressing down the flat spring 4 (toward the thermal head 1) changes, so that it is possible to adjust the pressure applied to the thermal head by way of the head plate 2.

As a result, according to this embodiment, the lever 32, the cam shaft 33 and the eccentric cam 31 function as a pressure adjusting means for adjusting the pressure applied to the platen by the thermal head.

A groove 33*a* which is used for changing the relative position of the lever 32 to the eccentric cam 31 is formed on the front side surface of the cam shaft 33 as illustrated in FIG. 5.

Steps of adjusting the pressure applied to the platen 5 is as follows. The fixing screw 35 for fixing the lever 32 to the cam shaft 33 is loosened, then a tool is inserted into the groove 33*a* to turn the cam shaft 33 and consequently the eccentric cam 31 so that the pressure may be at a desired value when the lever 32 is at the position indicated by a solid or an imaginary line in FIG. 5. Thereafter the fixing screw 35 is retightened to fix the lever 32 to the cam shaft 33.

Figure 6:
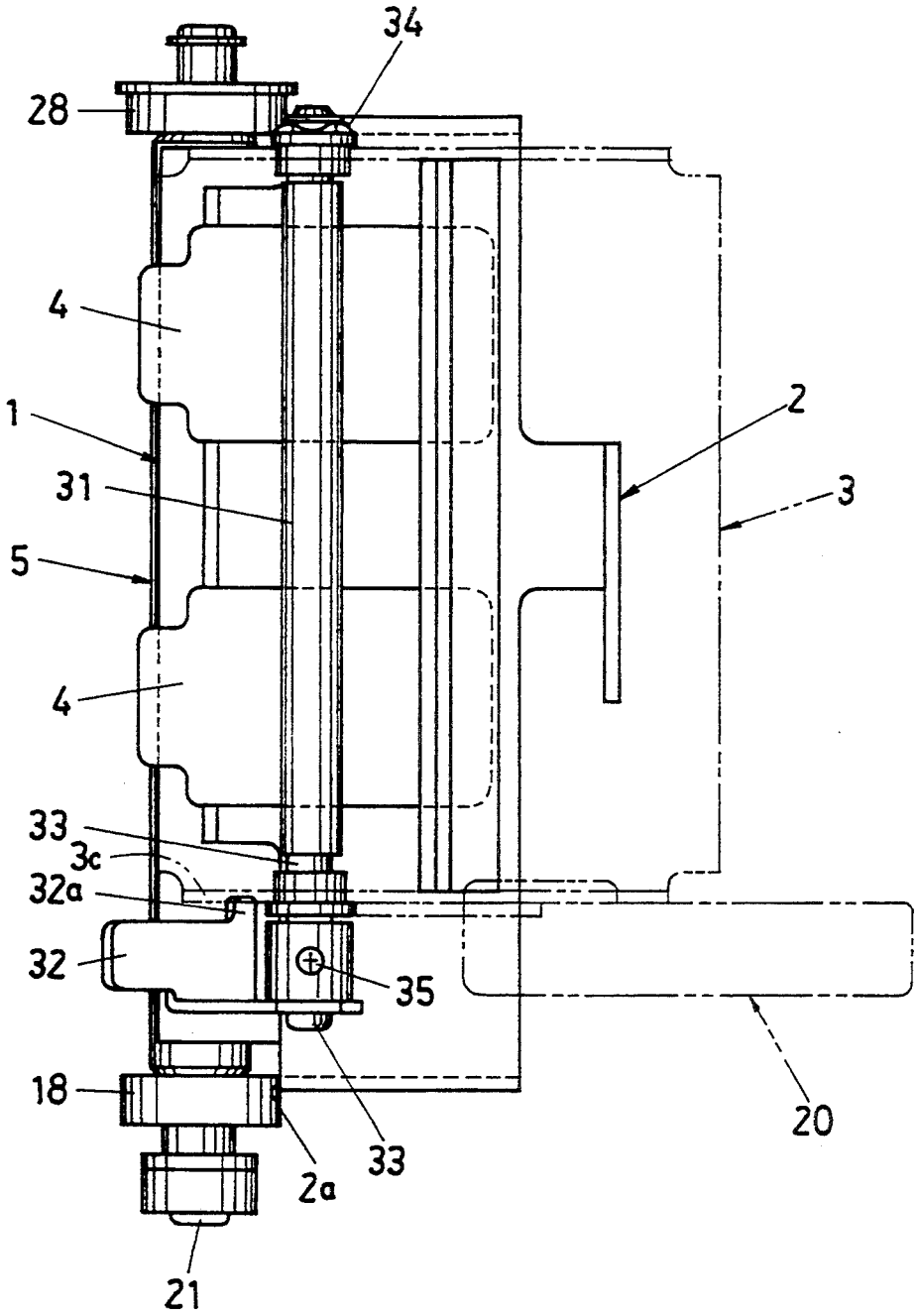
FIG. 6 is a plan view for explaining a mechanism for holding a lever 32 of the pressure adjusting means at the turned position.

The lever 32*a* comprises a projection 32 at the end edge on the side of the head frame 3 as illustrated in FIG. 6, and positioning holes 3*f* and 3*g* are respectively formed on the front side surface 3*c* of the head frame 3 corresponding to the projection 32*a* as illustrated in FIG. 5. The lever 32 is held at the position indicated by the imaginary line in FIG. 5 wherein the pressure is high and at the position indicated by the solid line in FIG. 5 wherein the pressure is low by allowing the projection 32*a* to engage the positioning hole 3*f* and 3*g*.

The thermal printer is provided with a pressure switching means which is capable of switching between the position for applying the pressure of the thermal head to the platen 5 and the position for removing the same.

The pressure switching means comprises a cam shaft 14 rotatably mounted between a standard side plate 80 and the front side plate 13, pressing cam 26 (also refer to FIG. 2) and a lever 15 fixed to the edge portion of the cam shaft 14 at the front side thereof. The pressing cam 26 can be turned from the position illustrated in FIG. 1 to the position illustrated in FIG. 7 by turning the lever 15.

Figure 7:
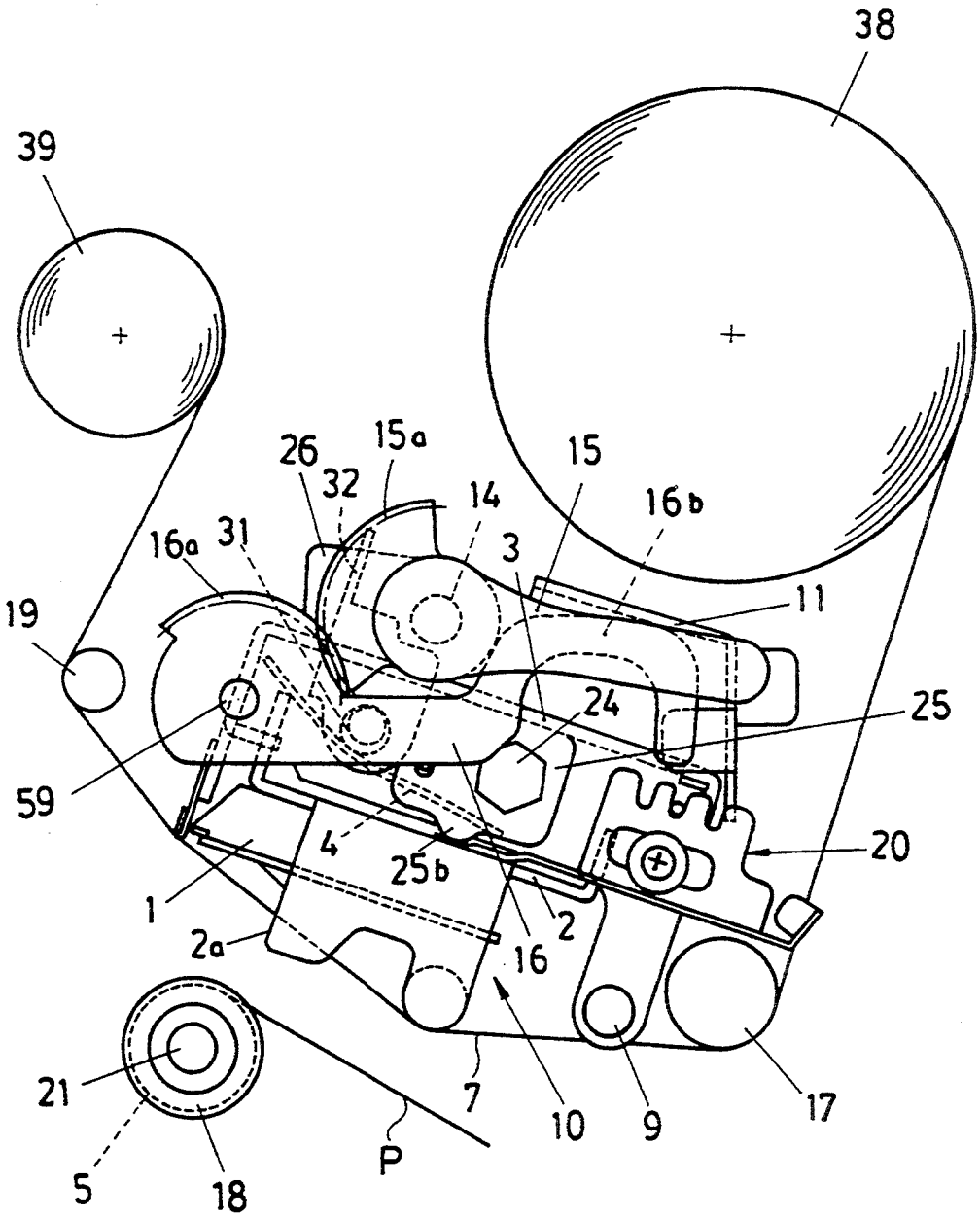
FIG. 7 is a front view showing a state where a lever 15 is turned to the position to remove the pressure.

When the lever 15 is turned to the position illustrated in FIG. 7, the pressure applied to the platen 5 by the thermal head 1 is removed, which facilitates the attachment or detachment of the tag paper P and the thermal transfer ribbon 7. When the lever 15 is turned to the position illustrated in FIG. 1, the thermal head 1 applies a pressure to the platen 5 so as to enable printing.

The thermal printer is provided with a hook 16 for clamping the bearing 18 which supports the shaft 21 of the platen 5 so as to prevent the same from moving vertically in a state where printing is possible as illustrated in FIG. 1.

The hook 16 is rotatably supported by a shaft 59 fixed to the front side plate 13, and a hook gear 16*a* which is provided in the upper portion of the hook 16 engages a lever gear 15*a* which is provided in the lower portion of the hook 16 as illustrated in FIG. 2. As a result, the hook 16 is turned following the turning of the lever 15.

That is, in printing, The lever 15 is turned in the direction of the arrow C so as to turn the hook 16 to the position as illustrated in FIG. 1, so that the bearing 18 which supports the shaft 21 of the platen 5 is put in the C-shaped portion 16*b* formed at the lower portion of the hook 16 and is clamped therein, thereby eliminating the problems such as the divergence in position between the back side plate 8 and the front side plate 13 due to a dimensional variation in each portion which is liable to occur in the head unit cantilever supporting system employed in this embodiment or a bending caused by the structure thereof.

Since the hook 16 is turned to the upper position in FIG. 7 following the turning of the lever 15 to the position in the same figure when a tag paper P or a thermal transfer ribbon is set to or detached from the platen 5, the lever 15 does not obstruct the attachment or the detachment of the supplies or the head assembly 10.

In the thermal printer according to this embodiment, the head balance switching lever 20 as illustrated in FIG. 5 is set to the positioned beneath the projection 25*b* at the thick plate portion 20*b* thereof when, for example, a thin tag paper having a width of about one fourth of the longitudinal length of the platen 5 is set one-sided on the platen 5 being adjusted to the front side as illustrated in FIG. 1.

As a result, since the head plate 2 is pressed down at the front side thereof by the amount corresponding to the difference in thickness between the thin plate portion 20*a* and the thick plate portion 20*b*, the thermal head 1 is forced to be inclined in the direction wherein the thermal head 1 is separated from the platen 5 at the back side thereof, so that printed letters of good quality can be obtained without generating a trouble such as the friction between the back side of the platen 5 and the thermal head 1.

When both of the thin plate portion 20*a* and the thick plate portion 20*b* of the head balance switching lever 20 are taken away from beneath the projection 25*b* of the stopper 25, the head plate 2 is raised at the front side as illustrated in FIG. 5 by the amount corresponding to the thickness of the thin plate portion 20*a*. As a result, the thermal head 1 is forced to be inclined so as to separate the front side thereof from the platen 5, so that printed letters of good quality can be obtained without generating a trouble such as the friction between the thermal head 1 and the front side of the platen 5 even if, for example, a thin and narrow tag paper having a width of about one fourth of the longitudinal length of the platen 5 which is set one-sided on the platen 5 being adjusted to the back side thereof.

Since running life of the thermal head 1 is shortened when the thermal head 1 is used on such a narrow tag paper with too strong pressure per unit length applied to the platen 5, the lever 32 is set to the position indicated by a solid line in FIG. 5 to lower the pressure applied to the platen 5.

In case of exchanging the thermal head 1, the lever 15 is turned to the position as illustrated in FIG. 7 to remove the pressure applied to the platen 5 by the thermal head 1, then the lever 32 is turned to the position illustrated in a broken line in FIG. 5 wherein the pressure is removed, and the tension spring 22 is detached from the head plate 2.

The retaining pawl 3*b* of the head frame 3 come out of the retaining hole 2*d* of the head plate 2 when the head assembly 10 in which the thermal head 1 is incorporated is shifted tightward in FIG. 5, so that the head assembly 10 can be taken out with ease.

Accordingly, although the thermal head in such a thermal printer is generally one of expendable supplies because of its running life of about 30 km, the thermal head can be easily exchanged together with the head assembly 10 in which it is incorporated according to this embodiment.

Since the head assembly 10 is assembled with high dimensional accuracy (constant) of the distance L between the printing portion 1*a* of the thermal head 1 and the stopper portions 2*a* and 2*b* of the head plate 2 which contact the beatings 18 and 28 for supporting the shaft 21 of the platen 5 when the head is mounted thereon as described with reference to FIG. 4, the thermal head 1 need not be adjusted in position relative to the platen 5 after the exchange thereof since the thermal head 1 is exchanged together with the head assembly 10.

Figure 8:
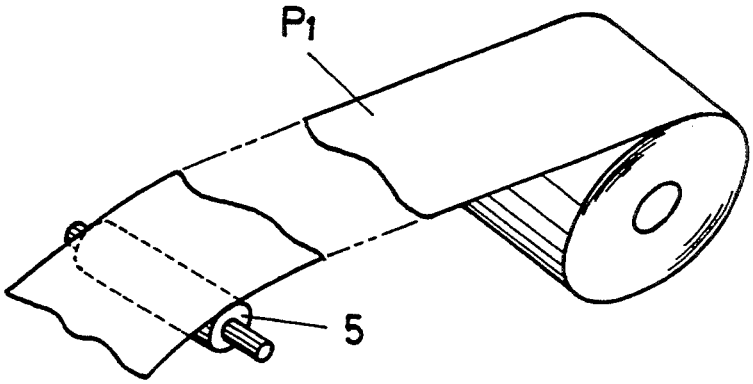
FIG. 8 is a perspective view showing a wide tag paper used in the thermal printer according to the present invention and its set position relative to the platen 5.
Figure 9:
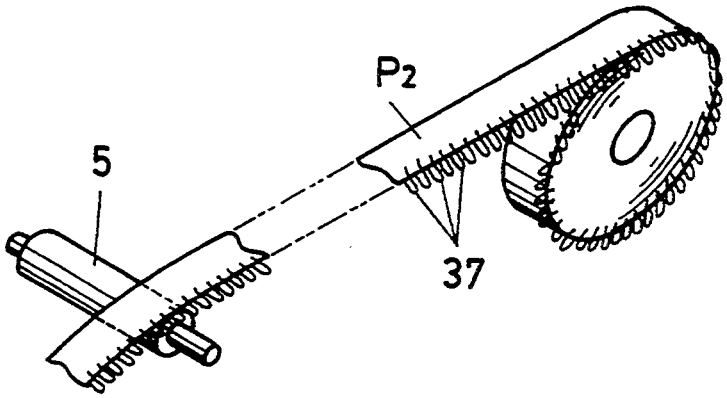
FIG. 9 is a perspective view showing a narrow tag paper with string and its set position relative to the platen 5.
Figure 10:
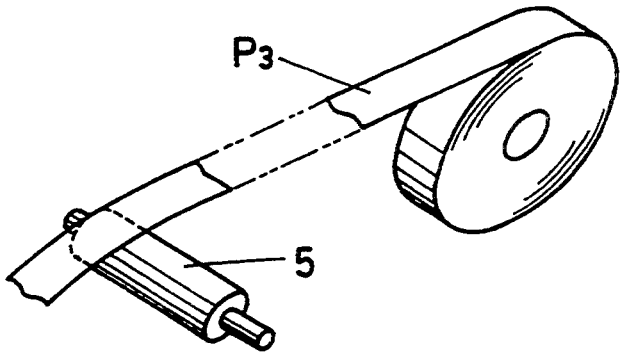
FIG. 10 is a perspective view showing a narrow tag paper and its set position relative to the platen 5.

FIGS. 8 to 10 show the shapes of representative tag papers used in the thermal printer according to the embodiment and the set positions thereof relative to the platen 5 in printing respectively.

FIG. 8 shows a tag paper P1 having a width substantially as wide as the longitudinal length of the platen 5. When the wide tag paper P1 is pressed and transported between the platen 5 and the thermal head 1 (refer to FIG. 1), the platen 5 and the thermal-head 1 are horizontally held in parallel with each other as illustrated in FIG. 2 by inserting the thin plate portion 20*a* of the head balance switching lever 20 beneath the projection 25*b* of the stopper 2 illustrated in FIG. 5.

In case of the wide tag paper P1, the pressure applied to the head plate 2 by the flat spring 4 is increased by turning the lever 32 to the position indicated by an imaginary line as illustrated in FIG. 5, since the platen 5 receives the load of the flat spring 4 by way of the tag paper P1 substantially along the whole width thereof.

FIG. 9 shows a narrow tag paper P2 to which a string 37 is attached at a side portion thereof for attaching a price tag to merchandise such as clothes.

Figure 11:
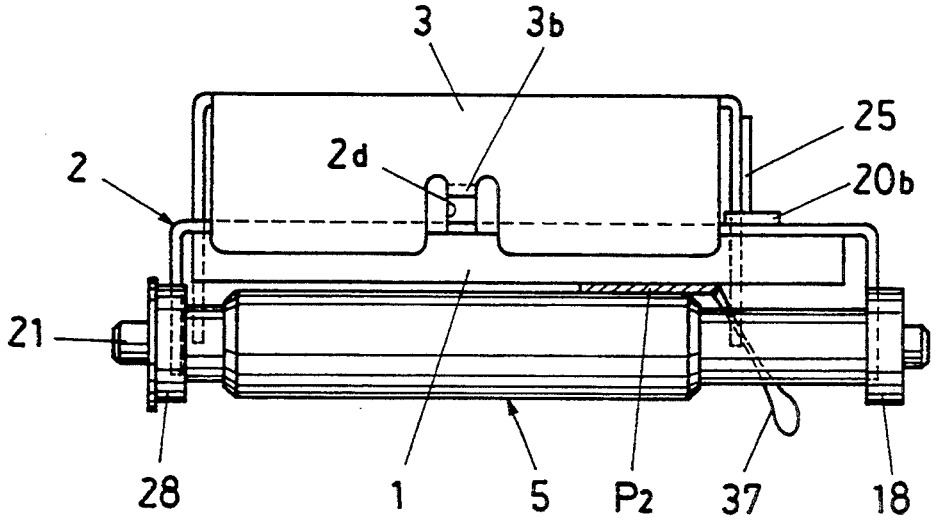
FIG. 11 is a simplified left side view showing a state where the narrow tag paper P2 with string in FIG. 9 is set between the thermal head 1 and the platen 5 adjusted to the front side.

When a given printing is performed on the narrow tag paper P2 with string, the thick plate portion 20*b* of the head balance switching lever 20 is inserted beneath the projection 25*b* of the stopper 25 and the narrow tag paper P2 with string is set on the platen 5 right adjusted (adjusted to the front side of the device) as illustrated in FIG. 11.

Consequently, the thermal head 1 can be held substantially in parallel with the platen 5 with the left side thereof a little lifted, so that the thermal head 1 can be prevented from inclining with the left side down and rubbing the platen 5.

The narrow tag paper P2 with string is set on the platen 5 right adjusted in FIG. 11 so as to prevent the string from entering between the platen 5 and the thermal head 1 to make a gap between the thermal head 1 and the printing surface of the narrow tag paper P2 with string, and the string 37 is dropped on the right side of the platen 5 as illustrated in FIG. 11 so as to prevent the string 37 from entering between the platen 5 and the thermal head 1.

In case of the narrow tag paper P2 with string, the lever 32 is turned to the position indicated by a solid line in FIG. 5 to decrease the pressure of the flat spring 4 since the platen 5 receives the load of the thermal head 1 only at a narrow area on the front side of the platen 5 (right side in FIG. 11) and consequently the load per unit length of the thermal head 1 becomes so large as to reduce the running life of the thermal head 1 if the pressure of the flat spring 4 is kept as it is.

Figure 12:
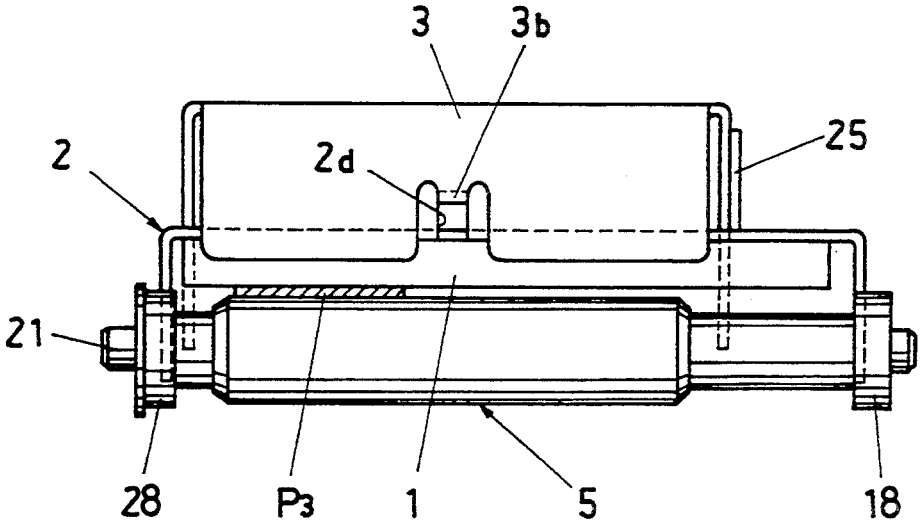
FIG. 12 is a simplified left side view showing a state where the narrow tag paper P3 in FIG. 10 is set between the thermal head 1 and the platen 5 adjusted to the back side.
Figure 13:
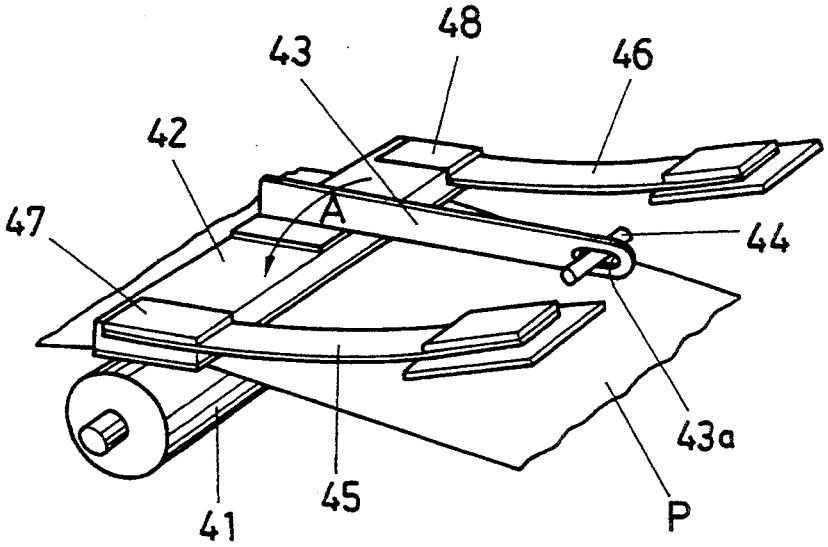
FIG.13 PRIOR ART
FIG. 13 is a perspective view showing an example of a head pressing mechanism in a conventional thermal printer.
Figure 14:
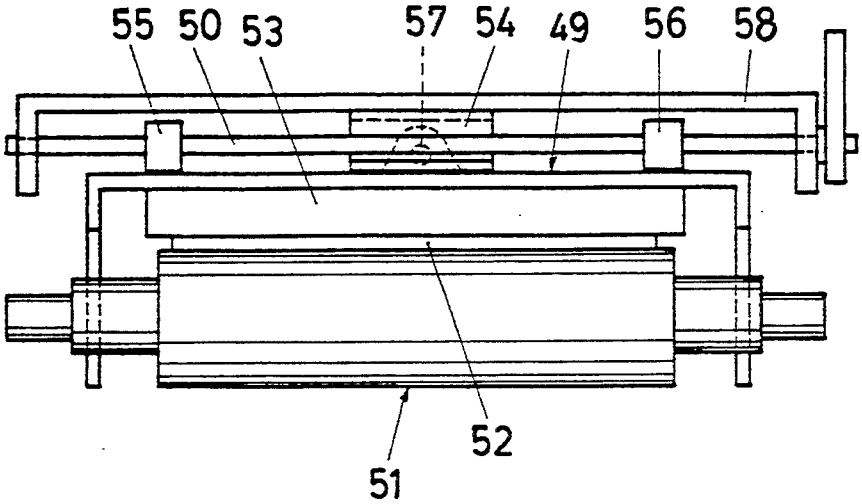
FIG.14 PRIOR ART
FIGS. 14 and 15 are a left side and a front views showing another example of a head pressing mechanism in a conventional thermal printer.
Figure 15:
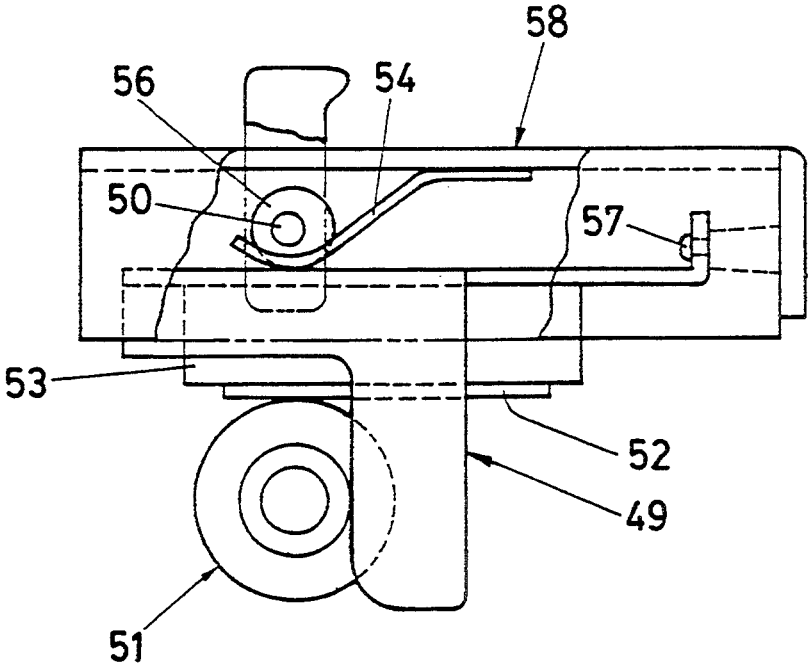
FIG.15 PRIOR ART

FIG. 10 shows a narrow tag paper P3 without string. When a given printing is performed on the narrow tag paper P3, the narrow tag paper P3 is set on the platen 5 left adjusted (on the back side of the device) as illustrated in FIG. 12. Then the lever 32 is turned to the position indicated by a solid line in FIG. 5 for low load and the head balance switching lever 20 is shifted to the position wherein both of the thin plate portion 20*a* and the thick plate portion 20*b* are taken away from beneath the projection 25*b* of the stopper 25.

As a result, the thermal head 1 can be prevented from inclining with the right side down and rubbing the platen 5 since the thermal head 1 can be held substantially in parallel with the platen 5 lifting the right side thereof a little, contrary to the printing on the wide tag paper P2 with string set forth above.

As described above, it is possible to perform a uniform printing without generating a friction between the thermal head 1 and the platen 5 even if the tag paper is largely varied in width and thickness and is set longitudinally at any position of those back side adjusted, front side adjusted and center adjusted on the platen 5.

The number of adjusting stages of the pressure adjusting means composed of the eccentric cam 31, the lever 32, etc. which was described referring to FIG. 5 may be optionally determined according to the allowance of width of the tag paper used for printing.

For example, if the width of the tag paper used for printing is on the order of 20 to 50 mm, the adjustment is not necessary, if it is on the order of 20 to 100 mm, the adjustment may be two-staged and if it is on the order of 20 to 150 mm, the adjustment may be three-staged.

Although the bearings 18 and 28 for supporting the platen 5 at both ends thereof function as positioning members, exclusive positioning members besides the bearings 18 and 28 may be provided, and they may have a circular-arc outer circumference having the center thereof in common with the shaft 21 at least only at a portion of the outer circumferential edge thereof which is capable of contacting the stopper portions 2*a* and 2*b* (serves as contacting members) of the head plate 2 instead of the outer circumference of a perfect circle.

Moreover, the thermal printer can be used for the thermal printer portion of a tag publishing device, a ticket publishing device, a label publishing device, etc.

The thermal printer according to the present invention can always obtain clear printed letters regardless of the width or the thickness of the recording paper such as a tag paper, a label paper, etc. used therein. Furthermore, even if a narrow recording paper is set on the platen longitudinally one-sided thereon, it is possible to prevent the abrasion of the platen due to the direct contact between the thermal head and the platen and to prevent the density of the printed letters from extremely low at one side of the recording paper.

The density of the printed letters can be always uniform all over the recording paper since the pressure applied to the platen by the thermal head can be made substantially uniform all over the surface of the platen in the axial direction thereof by adjusting either of the swinging restriction means provided on both sides of the head pressing mechanism for restricting the swinging of the thermal head about the longitudinal central portion thereof.

Still furthermore it is possible to obtain clearer printed letters by providing a pressure adjusting means for adjusting the pressure applied to the platen by the thermal head since the pressure can be adjusted to an optimum value according to the thickness of the recording paper, its longitudinal set position on the platen, moreover the width of the recording paper, etc.

It is also possible to easily exchange the thermal head as a unit by providing a pressure switching means which is switchable between the position for applying pressure and that for removing the same and switching to the latter at the time of exchange.

Having described in illustrative embodiment of the invention with reference to the accompanying drawings, it is to be understood that the invention is not limited to such a precise embodiment, and that various changes and modifications may be effected therein by one skilled in the art without departing from the scope and spirit of the invention as defined in the appended claims.

What is claimed is:

1. In a thermal printer comprising a platen having a shaft and a line type thermal head which is arranged substantially in parallel with the shaft of the platen, said thermal printer further comprising:

positioning members mounted on both ends of the shaft of the platen, each of said positioning members having a circular-arc edge portion center whose is in common with the shaft of the platen at least at a part of an outer circumference thereof, contacting members integrally formed with the thermal head for allowing a printing line of the thermal head to face a given position on an outer circumferential surface of the platen when the contacting members contact the edge portions of the positioning members, a head supporting means including means for resiliently supporting the thermal head so that the thermal head is movable toward or away from the platen while the contacting members contact the edge portions of the positioning members, a means for applying a pressure to the thermal head so that the thermal head is movable toward the platen, and swinging restriction means respectively provided on the head supporting means at a position corresponding to both longitudinal ends of the platen for restricting swinging of the thermal head about a longitudinal central portion of the thermal head.

2. A thermal printer according to claim 1, wherein the thermal printer is provided with a means for adjusting either of the restricting positions of the swinging restriction means so that pressure applied to the platen by the thermal head is substantially uniform all over a surface of the platen in an axial direction thereof.

3. A thermal printer according to claim 2, wherein the swinging restriction means restricts swinging of the thermal head by allowing stoppers provided on the head supporting means at positions respectively corresponding to both longitudinal ends of the platen to contact a head plate integrally fixed with the thermal head, and said means for adjusting either of the restricting positions of the swinging restriction means adjusts the restricting positions by inserting a position adjusting member composed of a plate having a given thickness between at least one of the stoppers and the head plate.

4. A thermal printer according to claim 1, wherein the thermal printer is provided with a pressure adjusting means for adjusting pressure applied to the platen by the thermal head.

5. A thermal printer according to claim 4, wherein the thermal printer is provided with a pressure switching means which is switchable between a position for applying pressure to the platen by the thermal head and that for removing said pressure.

6. A thermal printer according to claim 4 wherein said pressure adjusting means includes means for imparting a pressing force between said thermal head and said platen which is variable from a condition in which no pressure is imposed upon said thermal head for facilitating removal of said thermal head from said thermal printer to conditions in which variable pressing forces are imposed between said platen and said thermal head; and means for selectively operating said pressing force means.

7. A thermal printer according to claim 1, wherein the thermal printer is provided with a pressure switching means which is switchable between a position for applying pressure to the platen by the thermal head and that for removing said pressure.

* * * * *

UNITED STATES PATENT AND TRADEMARK OFFICE

CERTIFICATE OF CORRECTION

PATENT NO. : 5,414,450

DATED : May 9, 1995

INVENTOR(S) : Oshino et al.

It is certified that error appears in the above-indentified patent and that said Letters Patent is hereby corrected as shown below:

Title page, item [73], the assignee's name "Tohoku Richo Co., Ltd." should read -- Tohoku Ricoh Co., Ltd. --.

Signed and Sealed this

Twenty-first Day of January, 1997

*Attest:*

Bruce Lehman

BRUCE LEHMAN

*Attesting Officer*

*Commissioner of Patents and Trademarks*